United States Patent [19]

Ballantyne

[11] 4,387,633

[45] Jun. 14, 1983

[54] SLUDGE PROCESSING SYSTEM

[76] Inventor: James Ballantyne, 25 Cornish Dr., Westfield, Mass. 01085

[21] Appl. No.: 232,404

[22] Filed: Feb. 6, 1981

[51] Int. Cl.[3] ..... B30B 9/06

[52] U.S. Cl. ..... 100/48; 100/51; 100/116; 100/215; 100/218; 292/256.6

[58] Field of Search ..... 100/116, 125, 126, 215, 100/218, 250, 264, 45, 48, 50.51, 52; 210/350, 351; 44/10 G, 13; 292/256.6, 304

[56] References Cited

U.S. PATENT DOCUMENTS

| | | | |
|---|---|---|---|
| 406,161 | 7/1889 | Chabanel . | |
| 504,098 | 8/1893 | Wiesebrock | 100/116 |
| 772,472 | 10/1904 | Neill | 100/116 X |
| 838,841 | 12/1906 | Carlson | 100/116 |
| 1,826,729 | 10/1931 | Carver | 100/116 |
| 2,343,871 | 3/1944 | Livoti | 100/125 |
| 2,817,288 | 12/1957 | Peters | 100/52 |
| 2,877,599 | 3/1959 | Hebestreet . | |
| 2,977,214 | 3/1961 | McLellan . | |
| 3,195,761 | 7/1965 | Coats | 292/256.6 X |
| 3,522,768 | 8/1970 | Shann . | |
| 3,557,685 | 1/1971 | Schroering . | |
| 3,698,558 | 10/1972 | Weber . | |
| 3,779,153 | 12/1973 | Winningham | 100/116 |
| 3,802,335 | 4/1974 | Longo | 100/50 |
| 3,911,807 | 10/1975 | Burnbaum . | |
| 4,019,984 | 4/1977 | Mohn | 100/116 |
| 4,165,283 | 8/1979 | Weber . | |

*Primary Examiner*—Peter Feldman

*Attorney, Agent, or Firm*—George P. Hoare, Jr.

[57] ABSTRACT

A sludge processing system includes a cylindrical chamber with a piston slidably mounted therein. The chamber includes an inlet valve and an output port. Sludge contained within the chamber is compacted by the piston as expressing liquid exits from the chamber via the outlet port. The inlet port admits the sludge upon a withdrawal of the piston. Sieves on opposite ends of the chamber contain the particulate matter in the sludge as the liquid exits therefrom. A cake of solid sludge matter builds up upon successive strokes of the piston, and is then expelled by a final stroke of the piston via a door in an end of the chamber.

15 Claims, 10 Drawing Figures

SLUDGE PROCESSING SYSTEM

BACKGROUND OF THE INVENTION

This invention relates to waste processing and, more particularly, to the separation of the solid and liquid portions of sludge.

Systems for the treatment of waste are employed in important ecological and reclamation projects for the recycling of water, extraction of solids and specific chemical products, land fill, and fertilizers. The manner of treatment depends on the composition of the waste. Waste which is substantially solid matter, such as rubbish, is generally compacted to be suitable for land fill. Liquid waste is processed by settling tanks and filtration to remove particulate matter.

However, a problem arises in the case of sludge since it is too thick and viscous to be processed by settling and filtration as is done with the less viscous liquids, and has too high a water (or other liquid) content to be compacted as is done with solid waste. A further problem arises in the complexity of equipment utilized in the processing of waste, as well as the overly large physical size of such equipment as exemplified by multiple chambers, stirrers, screw conveyers, rotating drums, and similar large mechanical elements which militate against the installation of such equipment at small industrial sites.

SUMMARY OF THE INVENTION

The aforementioned problems are overcome and other advantages are provided by a sludge processing system comprising a cylindrical chamber with a piston slidably mounted therein, an inlet valve, an outlet port, and a sieve assembly. A mass of sludge is admitted into the chamber via the inlet valve whereupon the piston advances to compress the sludge into a cake and express fluid from the sludge via the sieve assembly. The expressed fluid exits via the outlet port. A door is provided in an end of the chamber, opposite the piston, for extraction of the cake upon completion of the fluid expression. Advantageously, two outlet ports and two sieve assemblies are provided, one sieve assembly incorporated into the face of the piston, and a second sieve assembly incorporated into an inner panel of the door. Each sieve assembly is formed of plural sets of serially disposed sets of fluid passages of increasing cross section directed from the center of the chamber. The finer openings of the sieve assemblies are in screens which face the chamber for engaging with particulate matter of the sludge, while the coarse openings in each assembly are provided by perforations in a plate located behind the sieve which supports the sieve against the forces of the sludge compression. The door, including the inner panel, is removably secured to the chamber so that, upon completion of the fluid expression and the formation of the resultant cake of particulate sludge matter, the door is released to permit expulsion of the cake by a final stroke of the piston.

A feature of the invention is the capability for producing a cake of sludge of particulate matter which is substantially as large as the chamber itself, thereby providing economy of space in the building of the sludge processing system. The building of the cake is accomplished in a sequence of strokes of the piston. The inlet valve is set within the face of the piston. Upon each retracton of the piston, the partially completed cake sits alongside the door panel and the inlet valve opens to admit more sludge into the chamber. With each compression stroke of the piston, the liquid within the newly admitted sludge is expressed through the sieve assembly in the piston face with some liquid also exiting the cake via the sieve assembly at the door panel. As the cake builds up, the subsequent strokes of the piston become progressively shorter until the chamber is substantially filled with the cake. A locking ring is advantageously employed for securing the door against the force of the piston, the ring being rotatable about the chamber for engagement and disengagement with the door. Hydraulic drive units, under control of a timer, advance and retract the piston, lock and unlock the door, and open and close the door.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
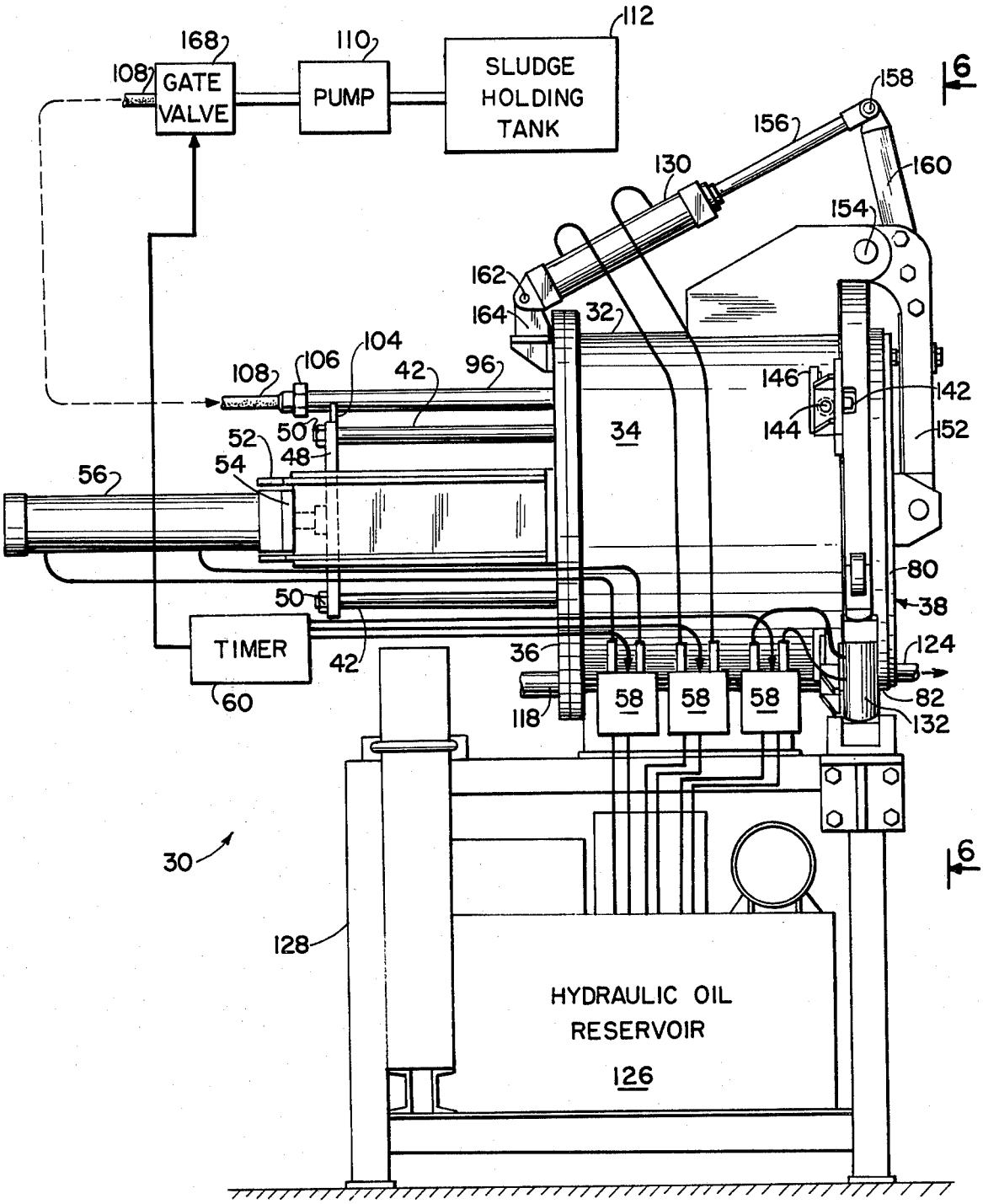
FIG. 1 shows the system of the invention and includes an elevation view of the chamber with portions of the hydraulic drive and timing shown diagrammatically.
Figure 2:
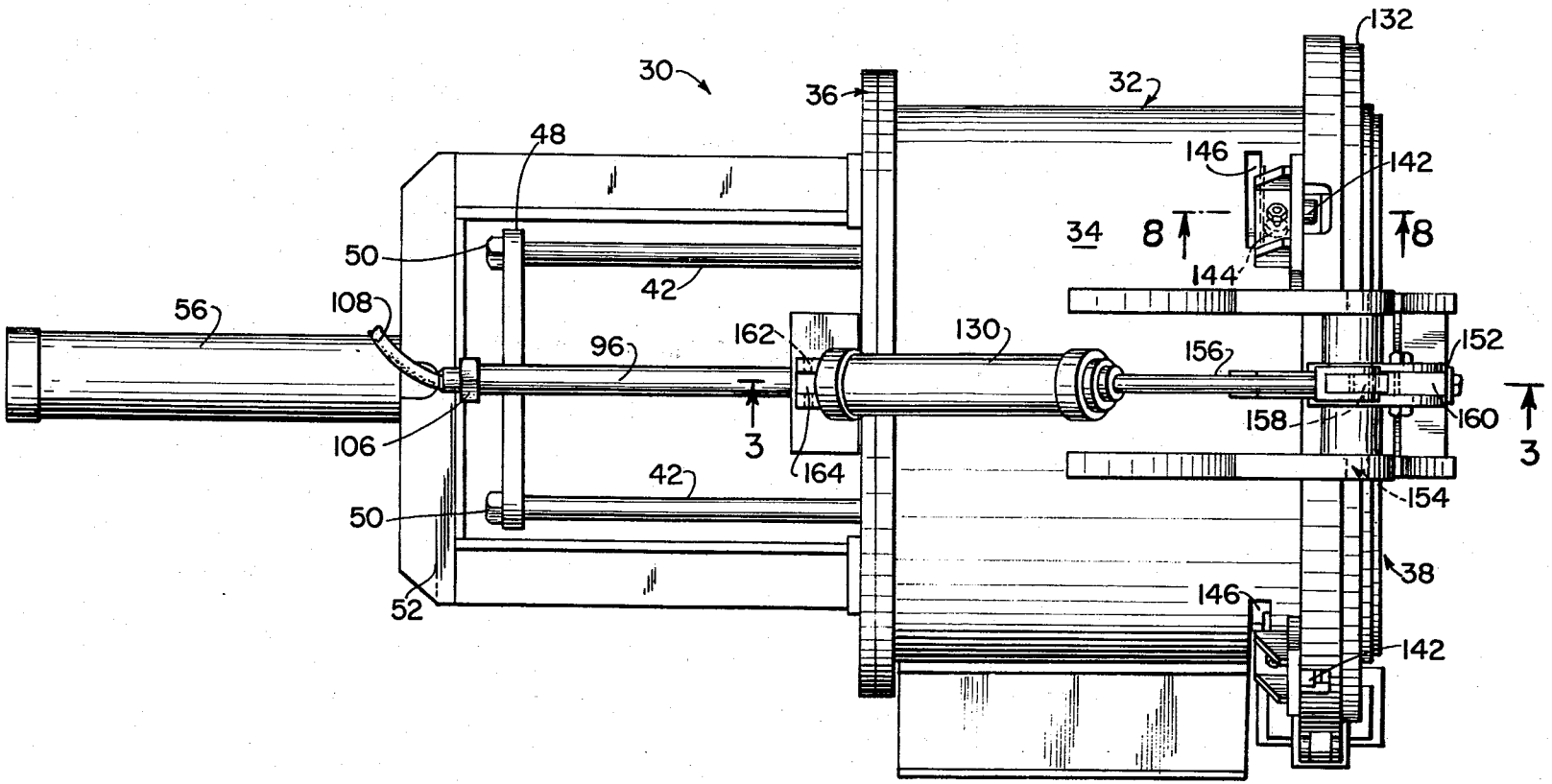
FIG. 2 is a plan view of the chamber of FIG. 1.
Figure 3:
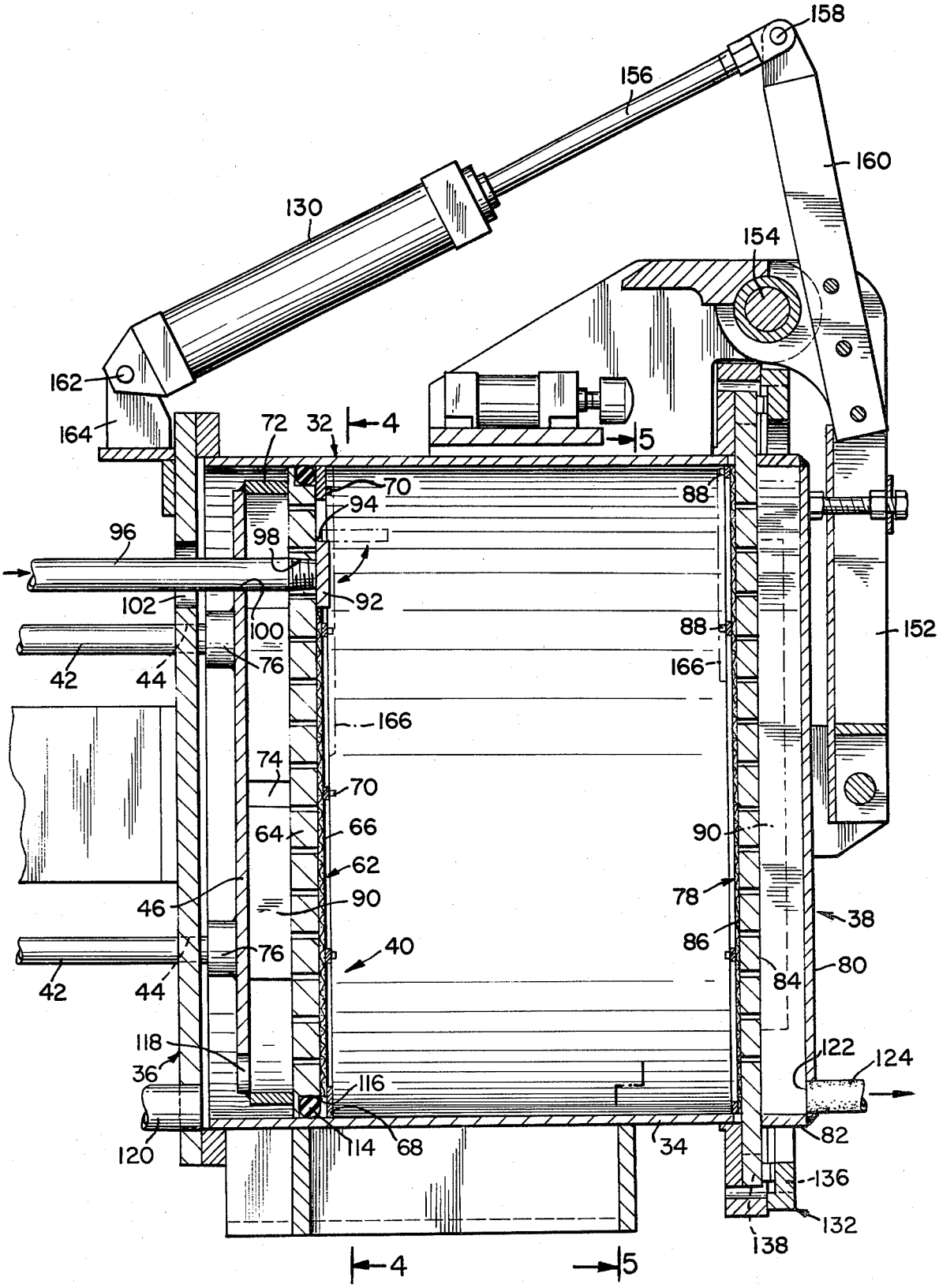
FIG. 3 is a longitudinal sectional view, taken along the line 3—3 in FIG. 2, showing a piston and sieve assemblies.
Figure 4:
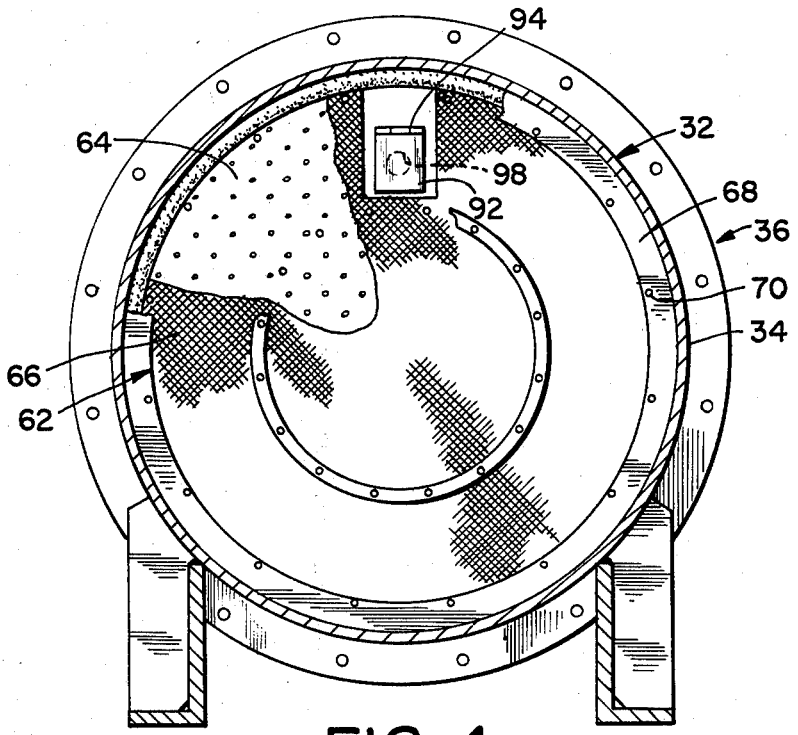
FIG. 4 is a transverse sectional view of the chamber, taken along the line 4—4 in FIG. 3, showing a sieve assembly and inlet valve located at the front face of the piston.
Figure 5:
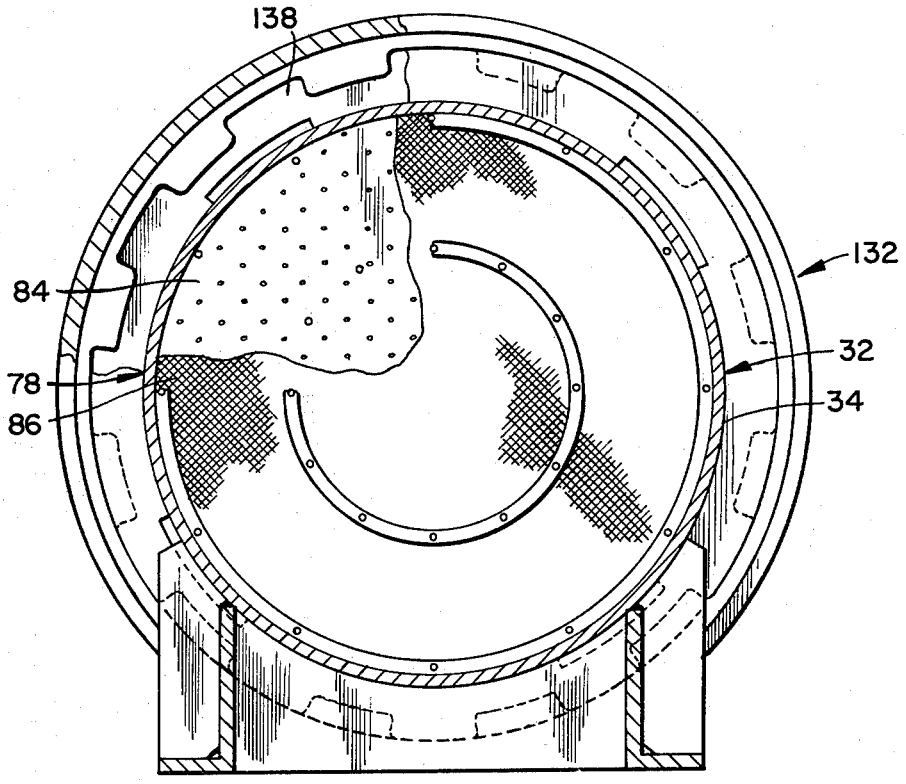
FIG. 5 is a transverse sectional view of the chamber, taken along the line 5—5 in FIG. 3, showing a sieve assembly in a panel within a door of the chamber.

Referring now to FIGS. 1–7, there is shown a waste processing system 30 constructed in accordance with the invention. The system 30 comprises a chamber 32 adapted for holding a charge of sludge from which fluid is to be expressed. The chamber 32 has a cylindrical sidewall 34 closed off by an end wall 36 and a door 38. A piston 40 is slidably mounted on the smooth interior surface of the sidewall 34, and is driven by a set of push rods 42 which are uniformly positioned about an axis of the piston 40. The pushrods 42 enter the chamber 32 via apertures 44 in the endwall 36 for engagement with a back plate 46 of the piston 40. In the preferred embodiment of the invention, four pushrods 42 are utilized, the ends of the respective rods 42 being joined together in a drive plate 48 secured by nuts 50 to threaded ends of the respective rods 42. The drive plate 48 is positioned by a guide 52 along which the drive plate 48 slides in response to a drive force exerted by the piston 54 of a hydraulic drive 56. The outer case of the drive 56 is conveniently secured to the guide 52. The drive 56 is activated in response to hydraulic fluids coupled by valves 58 which are operated by electric signals of an electronic timer 60.

The face of the piston 40 is formed as a screen assembly 62 comprising a perforated plate 64 having numerous apertures 65 disposed along its face, and a screen 66 secured thereto by a piston ring 68 which, in turn, is bolted to the perforated plate 64 by bolts 70. The perforated plate 64 is attached to the back plate 46 by a support ring 72 and a central strut 74. The securing of the back plate 46 to individual ones of the pushrods 42 is accomplished by bosses 76 interposed between the ends of the rods 42 and the back plate 46 for distributing the drive forces of the rods 42 about the back plate 46.

A second screen assembly 78 is formed as an inner panel of the door 38 and is secured to a cover plate 80 of the door 38 by a support ring 82. The screen assembly 78 is similar to the screen assembly 62 and similarly comprises a perforated plate 84, with apertures 85 therein, and includes a screen 86 secured to the face of the plate 84 by bolts 88. If desired, stiffening members in the form of ribs 90, shown in phantom view, may optionally be attached to the back surface of the perforated plate 84, with similar stiffening (not shown) being applied to the perforated plate 64.

The piston 40 is provided with a flapper inlet valve 92 secured to the front surface of the perforated plate 64 by a hinge 94. Sludge enters the chamber 32 via the inlet valve 92 upon a retraction of the piston 40. The sludge is conducted to the inlet valve 94 by a rigid pipe 96 which is secured within an aperture 98 of the perforated plate 64 and within an aperture 100 of the back plate 46 while passing through an aperture 102 in the endwall 36. If desired, the outboard end of the pipe 96 may be supported by a strut 104 of the drive plate 48. The pipe 96 is connected by a coupling 106 to a flexible hose 108 which permits translational motion of the pipe 96 during strokes of the piston 40 while connecting the pipe 96 to a pump 110. The pump 110 pumps sludge from a storage tank 112 via the hose 108 and the pipe 96 to the chamber 32 for expulsion of liquid from the sludge. The positive pressure of the sludge, due to the pumping action of the pump 110, opens the valve 92 upon retraction of the piston 40 from a cake of sludge within the chamber 32, and also opens the valve 92 when the chamber 32 is empty.

Liquid expressed from the sludge within the chamber 32 is inhibited from passing along the edge of the piston 40 by a circumferential ring-shaped seal 114 secured within a circumferential groove 116 disposed along the periphery of the piston 40. All fluid expressed from the sludge and passing through the screen assembly 62 of a piston 40 exits the chamber 32 by an outlet port 118 in the back plate 46 from whence the expressed fluids pass by a drain pipe 120 disposed at the bottom edge at the endwall 36. Similarly, fluids expressed via the screen assembly 78 in the door 38 exit by an outlet port 122 in the cover plate 80 for withdrawal via a flexible drain hose 124.

The chamber 32, the hydraulic drive valves 58, a pressurized source of hydraulic fluid 126, and the timer 60 are advantageously supported by a stand 128. In addition to the foregoing hydraulic drive 56 for operating the piston 40, a second hydraulic drive 130 is employed for opening and closing the door 38 while a third hydraulic drive 132 operates a locking ring 134 for locking and unlocking the door 38 from the chamber 32. The drives 130 and 132 are utilized at the completion of a fluid expression operation of the system 30 for the extraction of a cake of particulate sludge matter.

Figure 8:
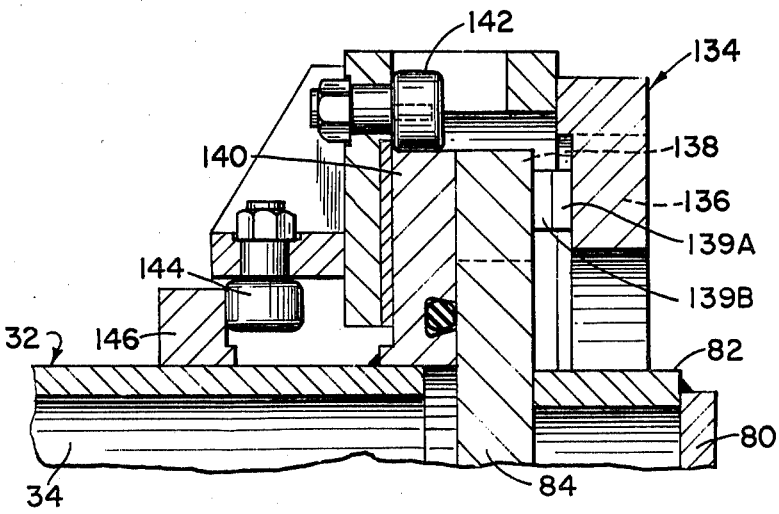
FIG. 8 is an enlarged view of bearings supporting a locking ring about the door taken along the line 8—8 in FIG. 2.
Figure 6:
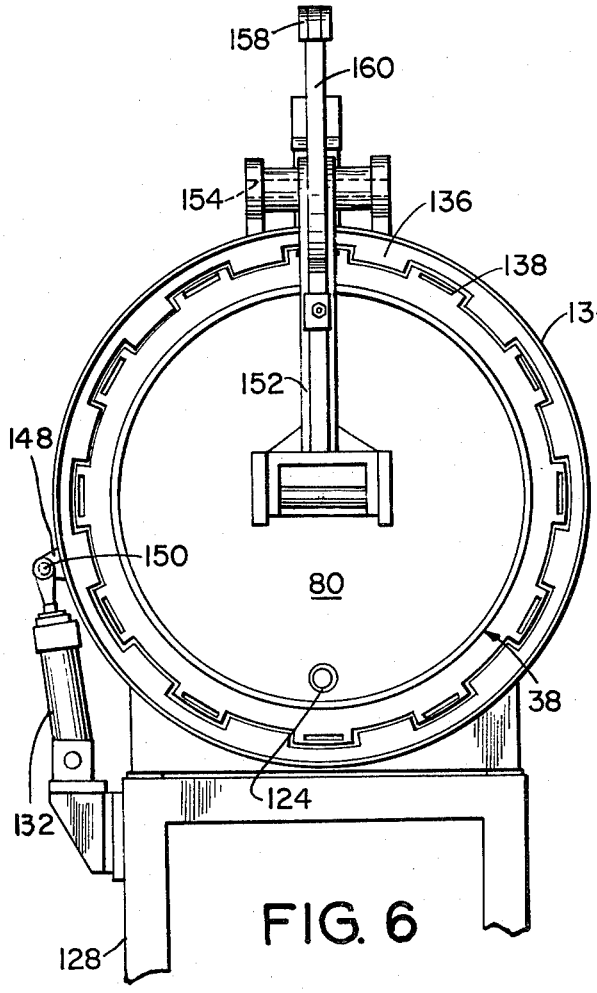
FIGS. 6 and 7 are end views of the chamber showing the door, the door providing for extraction of a cake of sludge material, the Figures also showing a locking ring of the door in the locked and in the unlocked positions, respectively, with FIG. 6 being taken along the line 6—6 in FIG. 1.
Figure 7:
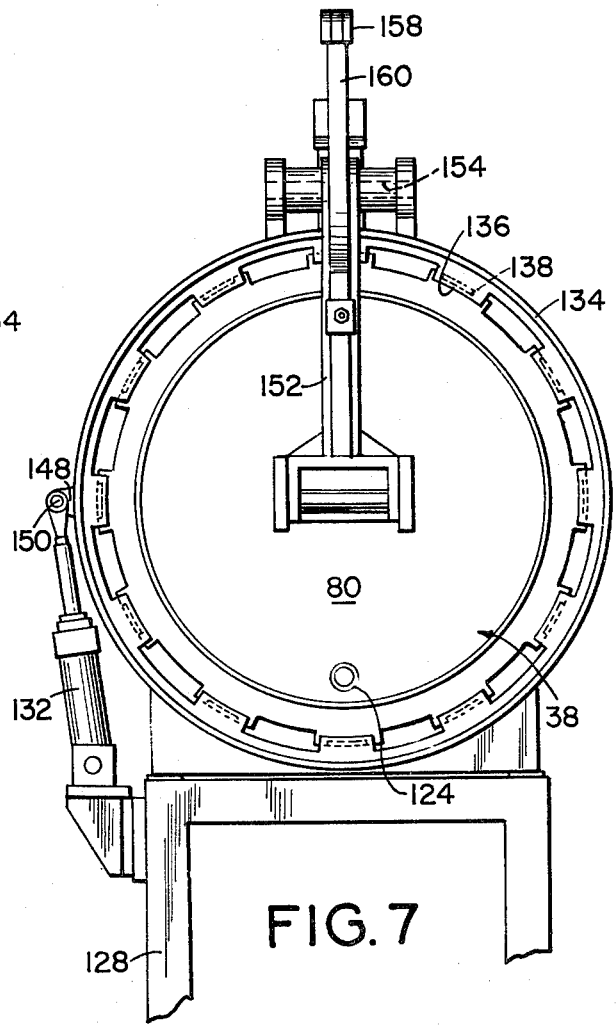
Figure 9:
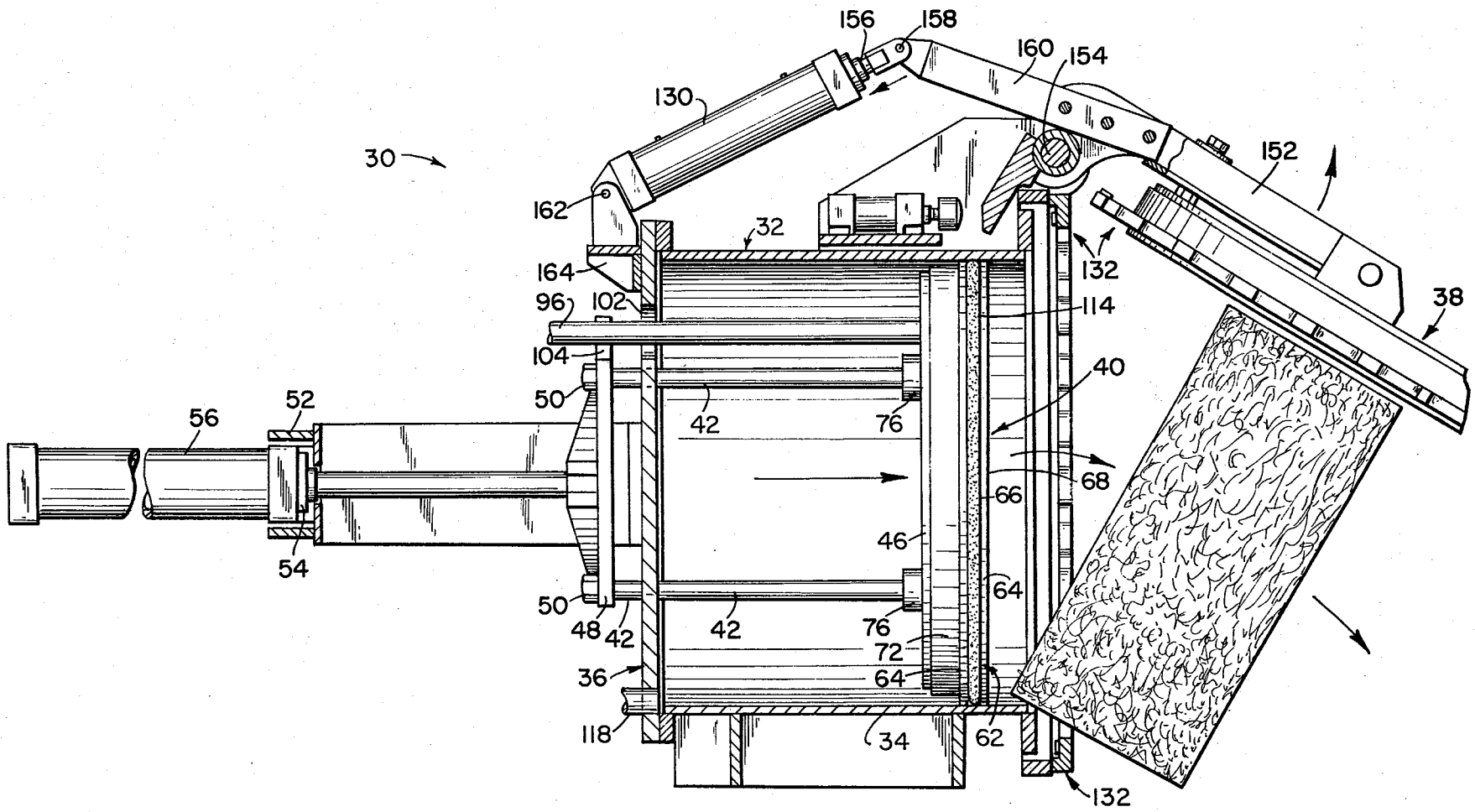
FIG. 9 is a view of the chamber with the door, including an end wall and panel thereof, opened for expulsion of the cake of particulate sludge matter, a cake being shown partially expelled.

Referring also to FIGS. 8–9, the locking ring 134 is disposed circumferentially around the periphery of the chamber 32 for engagement with the door 38. The ring 134 has a set of inwardly depending fingers 136 for engagement with a corresponding set of outwardly extending ears 138 of the plate 84. Contact between a finger 136 and an ear 138 is had by a tapered wedge 139A on the finger 136 which contacts a tapered wedge 139B and the ear 138. The ring 134 is secured to the end of the sidewall 34 by a circumferential flange 140, and is rotatable about the flange 140 by two sets of rollers 142 and 144. The rollers 142 rotate about the flange 140 around axes which are parallel to the central axis of the chamber 32. The set of rollers 144 rotate about axes which are radially disposed for rotation against a second flange 146 which positions the ring 134 along the central axis for engagement with the ears 138 of the door 38. Upon rotation of the ring 134, the fingers 136 are brought into registration with the ears 138 for securing the door 38 to the chamber 32 and, upon rotation in the reverse direction, the spaces between the fingers 136 come into registration with the ears 138 so as to free, or unlock, the door 38 from the chamber 32.

The foregoing rotation of the ring 134 is advantageously accomplished by the hydraulic drive 132 which is pivotably connected by a bracket 148 and pivot 150 to the ring 134. By securing the drive 132 to the stand 128, forces exerted by the drive 132 impart movement to the ring 134 relative to the stand 128 and, accordingly, relative to the chamber 32 which also is secured to the stand 128.

For opening and closing the door 38, an arm 152 secured to the cover plate 80 of the door 38 pivotably supports the door 38 by a pivot 154 located at the end of the sidewall 34 of the chamber 32. Thereby, the door 38, including its cover plate 80 and its screen assembly 78, can pivot relative to the end of the chamber 32 for opening and closing the chamber 32. The piston 156 of the hydraulic drive 130 is coupled by a pivot 158 to a lever arm 160 which is bolted to the arm 152. Thereby, upon extension of the piston 156 of the drive 130, the lever arm 160 and the arm 152 are pivoted about the pivot 154 for closing the door 38. Upon retraction of the piston 156, the door 38 swings open. The back end of the drive 130 is conveniently secured by a pivot 162 to a flange 164 extending from the end wall 36 of the chamber 32.

With respect to the fabrication of the piston 30, it is preferable that the chamber 32 and the piston 40 be fabricated of material which exhibits resistance to corrosion from substances and chemicals which may be in the sludge, and also exhibits sufficient strength to withstand the compressive forces on the sludge charge within the chamber 32 during the expression of fluid from the sludge. For example, both iron and stainless steel have the foregoing properties and are, accordingly, advantageously utilized in the fabrication of the chamber 32 and the piston 40. Similarly, the screen 66 and the screen 86 may be formed of woven steel wire. The coarseness or mesh of the screens 66 and 86 are selected in accordance with the granularity of the particulate matter in the sludge. A finer mesh is used when it is desired to trap relatively fine particles in the sludge cake, while a more coarse mesh may be used when only larger particles are found in the sludge, or in situations wherein the trapping of very fine particles is not required. For the entrapment of still finer particles which may be suspended in the liquid of the sludge, layers of filter paper 166 (partially shown in the figures) may be emplaced along the inner surfaces of the screens 66 and 86, this resulting in multiply tiered screen assemblies 62 and 78 wherein the fluid passageways are of increasing coarseness proceeding in a direction away from the center of the chamber 32. Thus, the filter paper 166, which has much finer fluid passages than does either of the screens 66 or 86, serves to entrain the particulate matter while the screens 66 and 86 serve as supporting structures for retaining the filter paper 166 in position under the compressive forces of the fluid expression operation. In turn, the screen 66 is supported by the perforated plate 64, and the screen 86 is supported by the perforated plate 84, both of which have fluid passageways that are more coarse than the passageways of the corresponding screens. The foregoing multiply tiered construction of the screen assemblies 62 and 78 is an important structural feature in that it provides for both the entrainment of the particulate matter and the expression of the fluid while overcoming the compression forces of the expression operation.

In operation, therefore, the pump 110 pumps sludge towards the chamber 32 from the storage tank 112, the pump 110 maintaining fluid pressure in the pipe 96 w hich forces open the valve 92 upon each retraction of the piston 40 for admission of the sludge into the chamber 32. The piston 40 is driven back and forth in a sequence of compression and retraction strokes for successively compressing the charge of sludge in the chambers 32. During each compression of the sludge charge, fluid contained within the spaces between the particulate matter of the sludge is expressed through the screen assemblies 62 and 78, and then exits the chamber 32 via the outlet ports 118 and 122 for subsequent storage in a holding tank (not shown).

Figure 10:
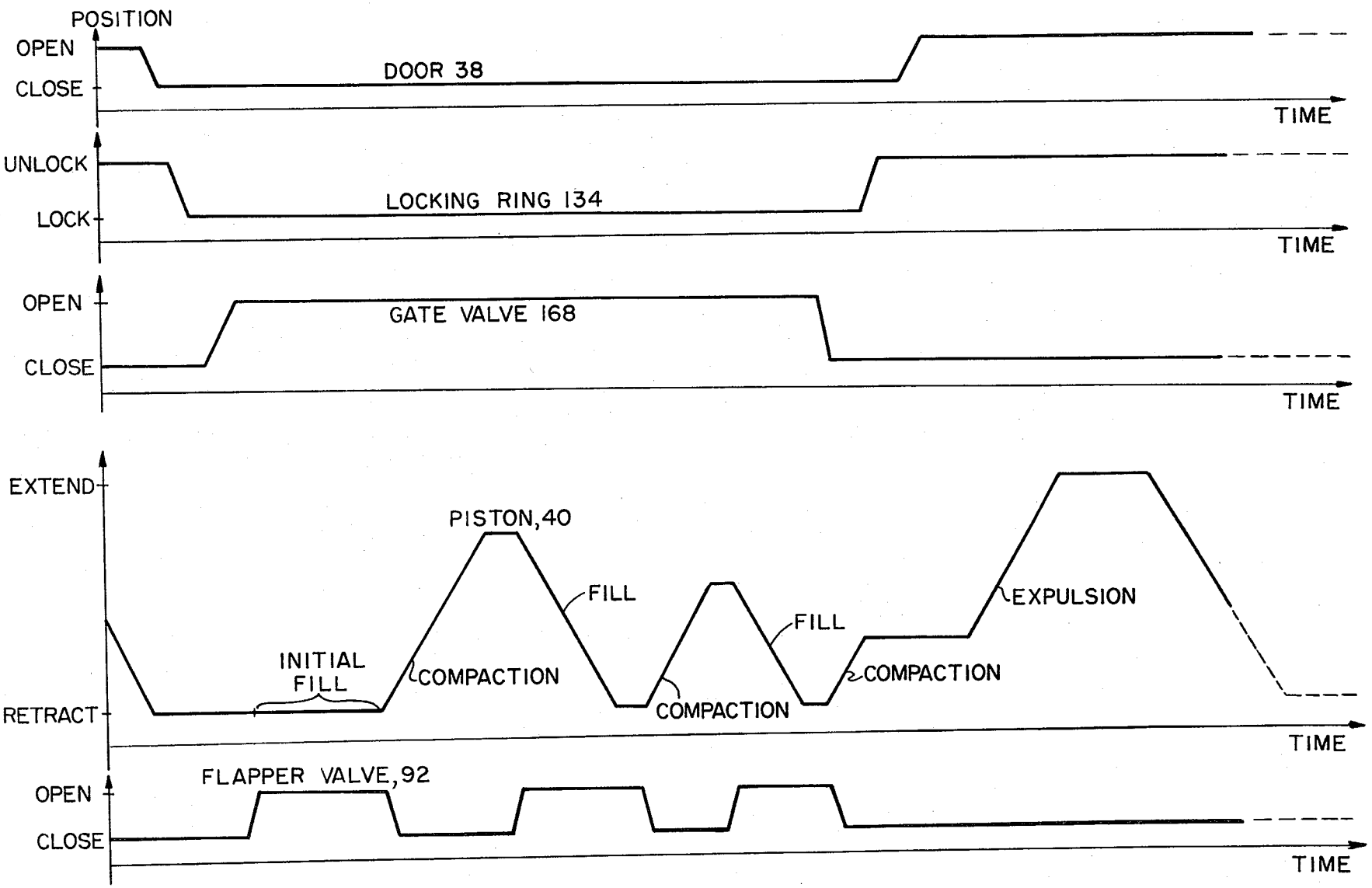
FIG. 10 is a timing diagram showing successive positions of the piston, as well as door and valve positions, during the operations of fluid expression and cake formation.

As shown in the timing diagram of FIG. 10, the successive compression strokes of the piston 40 become progressively shorter as the chamber 32 fills with further increments of the sludge charge. While three compression strokes are shown for purposes of illustration, it is to be understood that more compression strokes may be employed in forming a cake of sludge. Thus, with each subsequent compression stroke, the piston 40 expresses further fluid from the charge to produce a cake of the solid matter contained in the sludge. The cake grows progressively with each compression stroke of the piston. At the final stroke of the piston 40, the cake is sufficiently big so as to substantially fill the chamber 32, the dimensions of the resulting cake being substantially equal to the dimension of the chamber 32. Thereby, the system 30 provides a savings in space in that the resultant product has a size commensurate that of the compression equipment. A gate valve 168 responsive to a signal from the timer 60, is provided at the outlet of the pump 110 for terminating the flow of sludge at the completion of the sequence of compression strokes by the piston 40. Then, the door 38 is opened and, upon the final stroke of the piston 40, the cake of sludge matter is expelled from the chamber 32 into a receiving bin (not shown). The use of the foregoing arrangement provides for an economy of physical space and for a reduction and complexity of equipment in that the piston which performs the fluid expression also performs the expulsion of the cake from the chamber.

The operation of the timer 60 is also portrayed in the timing diagram of FIG. 10 wherein the signals transmitted by the timer 60 to the valves 58 for operating the hydraulic drives 56, 130 and 132, and the gate valve 168 are shown. By following the timing diagram, it is seen that the door 38 is closed, the ring 134 is positioned for locking the door 38 so as to secure it against the pressures of the expression operation, and the gate valve 168 is opened to admit the sludge into input feed pipe 96, whereupon the sequence of pistons strokes is initiated. The opening and closing of the flapper valve 92 is shown to follow the movements of the piston 40. Upon completion of the sequence of piston strokes and the development of the cake of sludge matter and the expression of the sludge fluid, the gate valve 168 is closed, the piston 40 is fully retracted, and the ring 134 is positioned for unlocking the door 38. Thereupon, the door 38 is opened and the piston 40 is advanced for expelling the cake. The timer 60 may be constructed in any one of a number of well known configurations; for example, a set of switches for activating the respective valve may be driven by a clock motor (not shown). Alternatively, an electronic clock and counter of clock pulses (not shown) may be employed for addressing a read-only memory (not shown) which, in response to the addresses, provides the electronic signals for activating the respective valves.

It is to be understood that the above-described embodiment of the invention is illustrative only and that modifications thereof may occur to those skilled in the art. Accordingly, this invention is not to be regarded as limited to the embodiment disclosed herein, but is to be limited only as defined by the appended claims.

What is claimed is:

1. A sludge processing system comprising:

an enclosure comprising a chamber with a piston therein for compressing a mass of sludge contained within said enclosure;

a sieve assembly located at a boundary of said enclosure to permit the egress of fluid from said mass of sludge upon the compression of said sludge by said piston, a door operatively connected to said enclosure which opens for extraction of a cake of said sludge formed upon the expression of said fluid therefrom, said door having outwardly extending projections about the outer periphery with spaces therebetween, a ring rotatably connected to said enclosure and positioned about the outer periphery of said door having inwardly extending projections with spaces therebetween, wherein rotation of said ring in one direction brings said projections into registration with one another for securing said door to said enclosure when said piston is compressing the sludge, and wherein rotation of said ring in the other direction brings said projections into registration with said spaces for unlocking and opening said door, and means connected to said ring for rotation thereof.

2. A system according to claim 1 wherein said sieve assembly includes a first and second sieve assembly each having sets of fluid passages of increasing coarseness progressing outwardly from said enclosure, the mesh of the innermost set of said passages being sufficiently fine to retain particulate matter of said sludge, the outermost set of said passages being formed as perforations in a supporting structure which urges said sieve assembly against said sludge for expression of said fluid, and wherein said sieve assemblies are disposed on opposite sides of said enclosure.

3. A system according to claim 2 wherein said first sieve assembly is disposed on the face of said piston.

4. A system according to claim 3 wherein said projections on said door and ring include opposing wedges extending therefrom which engage one another when said projections are in registration.

5. A system according to claim 2 wherein said second sieve assembly is disposed on the inner surface of said door.

6. A system according to claim 5 wherein said door includes an outer wall and a fluid exit port therein, fluid passing through said second sieve assembly exiting said enclosure via said port.

7. A system according to claim 1 further comprising:
means for opening said door;
means for driving said piston; and
timing means coupled to said opening means and said driving means for triggering their respective operations, said driving means driving said piston through a succession of compression and retraction strokes to express fluid from said sludge and form a cake of sludge matter remaining after said fluid expression.

8. A system according to claim 7 wherein said opening means opens said door upon a final stroke of said piston for expulsion of said cake by said piston.

9. A system according to claim 8, wherein said timing means also activate said ring rotation means prior to the opening of said door.

10. A system according to claim 1 wherein said sieve assembly is disposed on a front face of said piston, said piston including a back wall spaced apart from said sieve assembly to provide space for fluid expressed from said sludge.

11. A system according to claim 10 further comprising an inlet valve for sludge located in the face of said piston, said valve being closed by hydrostatic pressure formed in said sludge by a compression stroke of said piston.

12. A system according to claim 11 further comprising a fluid outlet port disposed in said back wall of said piston, fluid passing through said sieve assembly exiting from said enclosure via said port.

13. A system for the compaction of sludge material held within a chamber, said system comprising:
piston means in said chamber for exerting a succession of compaction strokes on a block of said sludge material supported within said chamber;
means within said chamber which permit the egress of fluid from the sludge upon compression thereof by said piston;
conduit means opening into said chamber for injecting further sludge into said chamber between said compaction strokes for enlargement of said block from stroke to stroke;
means including a door operatively connected to said chamber for extraction of said block upon the occurrence of the last of said succession of strokes to permit expulsion of said block from said chamber by said last stroke;
a door operatively connected to said chamber which opens for extraction of said block, said door having outwardly extending projections about the outer periphery with spaces therebetween; and
a ring rotatably connected to said chamber and positioned about the outer periphery of said door having inwardly extending projections with spaces therebetween, wherein rotation of said ring in one direction brings said projections into registration with one another for securing said door to said chamber when said piston is compressing the sludge into a block, and wherein rotation of said ring in the other direction brings said projections into registration with said spaces for unlocking and opening said door to permit expulsion of said block.

14. A system according to claim 13 wherein said last stroke occurs after said block attains a volume substantially equal to the volume of said chamber.

15. A system according to claim 13 wherein a piston of said exerting means includes plural sets of serially disposed fluid passages of increasing cross sections progressing outwardly in a direction from the center of said chamber for removal of fluid from said block while retaining suspended matter of said fluid within said block.

* * * * *